United States Patent [19]

Alley

[11] 4,130,141

[45] Dec. 19, 1978

[54] PICKER STICK

[75] Inventor: F. William Alley, Elmore, Vt.

[73] Assignee: Page Belting Company, Concord, N.H.

[21] Appl. No.: 854,475

[22] Filed: Nov. 23, 1977

[51] Int. Cl.[2] ..... D03D 49/38

[52] U.S. Cl. ..... 139/157

[58] Field of Search ..... 139/157

[56] References Cited

U.S. PATENT DOCUMENTS

| | | | |
|---|---|---|---|
| 2,440,181 | 4/1948 | Muller | 139/157 |
| 3,826,155 | 7/1974 | Muller | 139/157 |
| 3,901,287 | 8/1975 | Benedict et al. | 139/157 |
| 3,998,458 | 12/1976 | Inoue et al. | 273/80 R |
| 4,000,896 | 1/1977 | Lauraitis | 273/80 R |
| 4,003,778 | 1/1977 | Phillips | 156/289 |

FOREIGN PATENT DOCUMENTS

| | | | |
|---|---|---|---|
| 560533 | 10/1932 | Fed. Rep. of Germany | 139/157 |
| 2518455 | 11/1976 | Fed. Rep. of Germany | 139/157 |
| 1048457 | 8/1953 | France | 139/157 |
| 400062 | 11/1942 | Italy | 139/157 |
| 1427595 | 3/1976 | United Kingdom | 139/157 |

*Primary Examiner*—James Kee Chi

*Attorney, Agent, or Firm*—Norman S. Blodgett; Gerry A. Blodgett

[57] ABSTRACT

Picker stick formed of a carbon fiber reinforced plastic with a hollow center containing a vibration damping substance.

7 Claims, 7 Drawing Figures

PICKER STICK

BACKGROUND OF THE INVENTION

In a loom of the type where the weft is carried back and forth through the shed by a shuttle, the shuttle movement is brought about by the use of picker sticks. A swingable picker stick is located at each side of the loom and contacts the shuttle at the end of its motion to push the shuttle back in the opposite direction. The picker stick at each side of the loom swings in a vertical plane with angular deflection, which plane includes the loom lay and the path of the shuttle and the weft. In the past, the picker stick has been made of wood and often of laiminated wood whose layers are cemented together and impregnated with a substantial polymer. Wooden constructions has been desirable, first of all, because it is inexpensive and, secondly, because wood has inherent vibration damping from its very nature. While picker sticks of this type have operated in an adequate manner, nevertheless, it is desireable to increase the number of picks at which a given loom is operated, so that the loom is capable of higher production. When one attempts to speed up a loom with a wooden picker stick, however, the life of the picker stick (before it must be replaced), is somewhat limited. Therefore, even though wooden picker sticks are relatively inexpensive, the cost of replacing the stick overrides the desireable quality of cheapness; that is to say, in order to replace a broken or worn picker stick, it is necessary to shut down the machine. Of course, the overhead in the mill continues but without any production on that machine. Furthermore, it is necessary to supply skilled labor to repair the loom and replace the stick. It can be seen, then, that the economics of the weaving room can indicate possibly paying more money for a more substantial picker stick, if it is not only possible to operate the loom at a faster rate but also to avoid the downtime and repair costs.

Attempts in the past to make a longer-lasting picker stick, however, have been less than successful. For instance, attempts to use metals in the picker stick have always resulted in failure either because the metal is too heavy or, if a light alloy was used, had limited strength and life. A picker stick which is too heavy requires very large amounts of energy to overcome the inertia in its swinging motion and the light alloys are likely to be destroyed too quickly. Furthermore, most of the attempts to use materials other than wood in picker sticks have lead to vibration problems which arise because the picker stick is operated as a second degree lever with a normally free end, but which is struck a heavy blow at the time of contact with the shuttle. These and other difficulties experienced with the prior art have been obviated in a novel manner by the present invention.

It is, therefore, an outstanding object of the invention to provide a picker stick which is light in weight, which is practically indestructable, and which is not subject to vibration.

Another object of this invention is the provision of a picker stick which is light in weight and which, therefore, can be applied to existing looms and operated at a higher than normal speed without an increase in horsepower absorption by the loom.

A further object of the present invention is the provision of a picker stick which is reinforced in a novel manner by very strong fibers to resist destruction under heavy duty operation in a loom.

It is another object of the instant invention to provide a picker stick which is not subject to destructive vibration at high "pick" speeds.

A still further object of the invention is the provision of a picker stick which is simple in construction, which is inexpensive to manufacture, and which is capable of a long life of useful service with a minimum of maintenance or attention.

It is a further object of the invention to provide a picker stick which is capable of an extremely long life of useful service, thus reducing downtime and labor costs in connection with the operation of a loom.

It is a still further object of the present invention to provide a picker stick having a very durable nature, but whose flexibility can be readily designed to have exactly the desired spring constant.

Another object of the invention is the provision of a picker stick designed in such a way that its resonant frequency can be selected to relate in a desireable way to the frequencies and harmonics present in the remainder of the loom.

Another object of the invention is the provision of a picker stick which can be operated at a high rate of speed without exceeding a permissable sound level.

SUMMARY OF THE INVENTION

In general, the present invention consists of a picker stick for use in a lay shuttle loom. The stick is provided with an elongated main body which is adapted to swing in the vertical plane of the shuttle motion. The main body tapers evenly from a large lower end to a small upper end and a bore extends through the main body from one end to the other. A body of vibration and sound damping material lies in the bore.

More specifically, the bore for a substantial portion of the length of the main body in the upper portion is in the shape of an oval with the major axis extending in the direction of the plane of the shuttle motion. At the same time, the bore for a substantial portion of the length of the main body at the bottom portion is in the shape of a circle. The vibrator-absorbing material is a foamed polymer of low density that completely fills the bore. The main body is formed of a polymer reinforced with carbon fibers. Those fibers which are located in the interior of the body extend lengthwise and those located on the exterior extend in spirals to eliminate twisting or torque forces.

The character of the invention, however, may be best understood by reference to one of its structural forms, as illustrated by the accompanying drawings, in which:

DESCRIPTION OF THE PREFERRED EMBODIMENT

Figure 1:
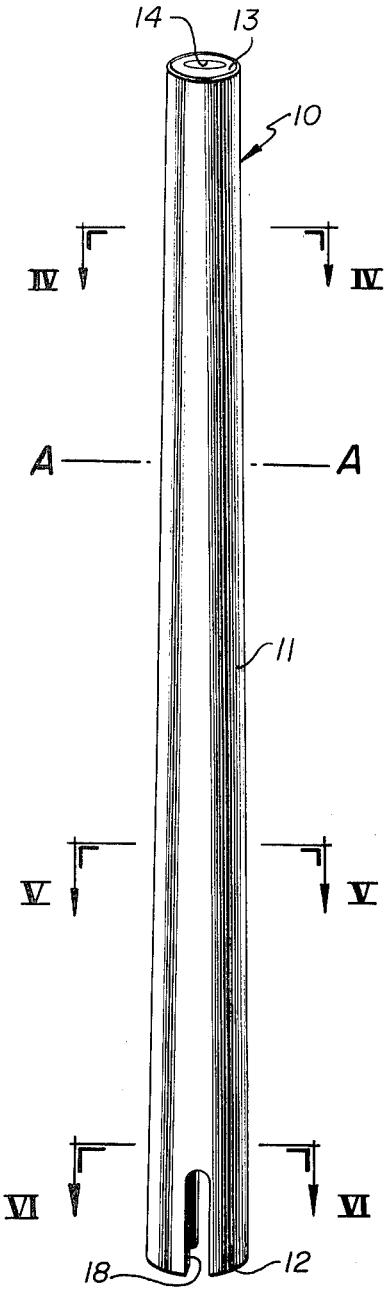
FIG. 1 is a perspective view of a picker stick embodying the principles of the present invention.
Figure 2:
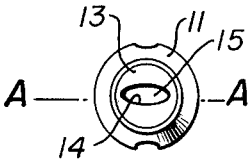
FIG. 2 is a top end view of the picker stick.

Referring first to FIG. 1, wherein are best shown the general features of the invention, the picker stick, indicated generally by the reference 10, is shown as of the type intended for use with a lay shuttle loom for swinging motion about a pivot adjacent its lower end in the shuttle plane A—A. The picker stick has an elongated main body 11 which tapers evenly from a large lower end 12 to a small upper end 13. A bore 14 extends entirely through the main body from one end to the other. This bore contains a body 15 of sound-and vibration-dampening material. The lower end is provided with an attaching means, such as a slot 18.

Figure 3:
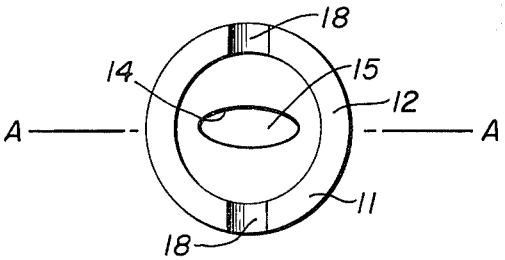
FIG. 3 is a bottom end view of the picker stick.
Figure 4:
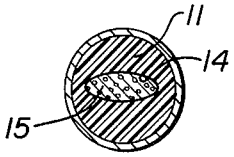
FIGS. 4, 5, & 6 are sectional views of the picker stick taken on the lines IV—IV, V—V, and VI—VI, respectively, of FIG. 1.
Figure 5:
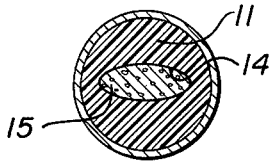
Figure 6:
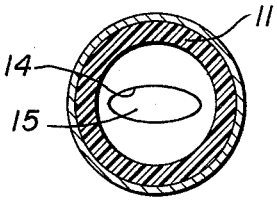
Figure 7:
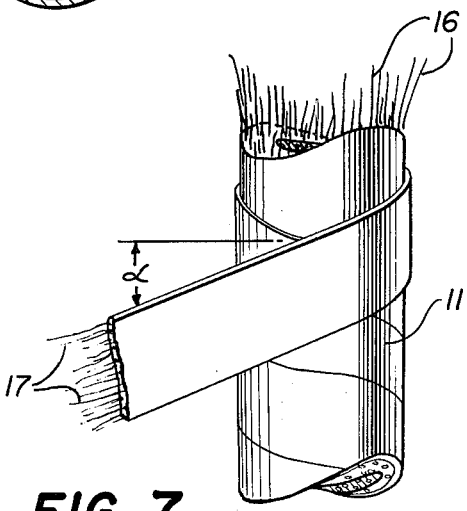
FIG. 7 is an enlarged view of a portion of the picker stick showing the details of construction.

As is particularly evident in FIGS. 4 and 5, the bore through a substantial portion of its upper length has a cross-section in the shape of an oval with its major axis lying in the plane A—A of the shuttle movement. The bore for a substantial portion of its length in the lower part of the main body has a circular cross-section, as is evident in FIGS. 3 and 6. FIGS. 4 and 5 show the sound-absorbing material as being in the nature of a foamed polymer having elastomeric qualities such as an elastomeric grade of foamed polyurethane. In any case the polymer is one of low density and completely fills the bore. FIG. 7 shows best the general construction of the main body as formed of a polymer reinforced with carbon fibers. The fibers 16 at the interior of the main body extend longitudinally of the body in parallel, spaced relationship to one another, while those fibers 17 that are located on the exterior are arranged in a spiral path relative to the longitudinal axis of the picker stick. The lead angle of the helices is designated as the angle is selected during manufacture of the picker stick to give the stick greater or lesser torque resistance.

The operation and the advantages of the picker stick of the invention will now be readily understood in view of the above description. The picker stick is mounted in the loom in association with various other parts of the loom such as the usual lug straps and the like which bring about the swinging movement of the picker stick to accelerate the shuttle at the appropriate time in its passage back and forth across the loom. Naturally, there will be one picker stick on each side of the loom, both being similar to the one described above. Since the picker stick is supported for swinging at its lower end, since the transverse axis of swinging is selected by means of the slot 18 in the bottom of the picker stick, since the force bringing about the swinging is applied by the lug strap, and since the shuttle engagement takes place at the upper end, the picker stick is operated in the general manner of a second degree lever. There is, however, a basic difference lying in the fact that the force applied at the point of the lever is applied suddenly and is released suddenly, so that the portion of the lever above the lug strap tends to vibrate as a cantilever spring.

The frequency and the amplitude of upper part of the picker stick can be very important in the operation of the loom and may lead to such undesireable consequences, for instance, as the fact that the loom will operate properly at only one "pick" speed this speed being commensurate with the natural frequency of the picker stick. By the use of the present invention, it is possible to make the picker stick very stiff, i.e., with a very high spring constant, K, so that what little vibration does take place, does so at a high frequency and low displacement, so that the shuttle effectively strikes the picker stick as though it were not vibrating at all. At the same time, the sound emitted by the picker stick is very much related to the natural frequency of the picker stick. The sound-and vibration-absorbing and damping material in the body 15 is selected to operate best at the natural frequency of the picker stick. The use of the oval-shaped bore for the substantial portion of the length of the picker stick (particulary in the upper part) means that the picker stick, even though it is of circular cross-section on its outer surface, has thinner walls at its end and thicker walls along its sides relative to the shuttle plane A—A. This means that it is stiffer in the plane of the shuttle and more flexible in the transverse direction. Construction in this way gives the picker stick the maximum amount of sound-absorbing material in the bore and a main body having the least weight for a given stiffness in the plane of the shuttle motion. In other words, by use of the present construction it is possible to obtain a picker stick of very high stiffness, yet with a low weight. This also means that the picker stick can be subjected to its to-and-fro motion with a minimum of horsepower absorbtion in reversing the direction of the picker stick and with a minimum of the vibration which is generally the limiting factor as to how fast the loom can be operated.

The picker stick is extremely durable, so that, even though its initial cost may be higher than the conventional wooden picker sticks, nevertheless the fact that the loom using the present picker stick will be subject to less downtime means that in the long run the loom will be more profitable. That is to say, it can be operated at a higher speed, i.e., a greater number of picks per minute and the downtime and the labor costs will be less.

The spiral nature of the fibers which reinforce the polymer tend to eliminate twisting due to the torque applied to the upper end. This torque is due to the forces applied perpendicularly by the shuttle motion and the lay motion. The picker which is attached to the picker stick exerts a torque force on the stick in the same manner as is experienced in a golf stick by the golf club head. The picker stick must be prevented from twisting, the socket in the picker must always be aligned with the shuttle spur throughout the swing of the stick in both directions.

It is obvious that minor changes may be made in the form and constructions of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. A picker stick for use in a fly shuttle loom, comprising:

(a) an elongated main body adapted to swing in the vertical plane of the shuttle motion, the main body having an outside surface which tapers from a larger lower end to a smaller upper end, a bore extending through a substantial portion of the length of the main body is ovate in cross section with the major axis extending in the direction of said plane of the shuttle motion, and (b) a body of sound and vibration-absorbing material lying in the bore.

2. A picker stick as recited in claim 1, wherein the ovate portion of the bore extends along the upper portion of the stick and the remaining portion of the bore at the bottom of the stick is circular in cross section.

3. A picker stick as recited in claim 1, wherein the picker stick is circular in cross section, and tapers evenly from the bottom to the top.

4. A picker stick for use in a fly shuttle loom, comprising:

(a) an elongated main body adapted to swing in a vertical plane of the shuttle motion, the main body having an outside surface which tapers evenly from a larger lower end to a smaller end, a bore extending through the main body from one end to the other, and (b) a body of foamed polymer of low density completely filling the bore for a substantial length of the bore, thereby providing sound and vibration-absorbing material properties to the picker stick.

5. A picker stick as recited in claim 4, wherein the main body is formed of a polymer reinforced with carbon fibers.

6. A picker stick as recited in claim 5, wherein the fibers located in the interior of the main body extend lengthwise and those located on the exterior extend in spirals.

7. A picker stick for use in a fly shuttle loom, comprising:

(a) an elongated main body adapted to swing in a vertical plane of the shuttle motion, the main body having an outside surface which tapers from a lower end to a smaller end, the outer portions of the body being formed with resin reinforced with fibers which are oriented in spiral paths to resist twisting, a bore extending through the main body from one end to the other, and (b) a body of sound and vibration-absorbing material lying in the bore.

* * * * *